US005546845A

United States Patent [19]

Wössner et al.

[11] Patent Number: 5,546,845

[45] Date of Patent: Aug. 20, 1996

[54] CARTRIDGE BELT

[75] Inventors: Ernst Wössner, Sulz; Mathias Braun, Meppen, both of Germany

[73] Assignee: Heckler & Koch GmbH, Oberndorf am Neckar, Germany

[21] Appl. No.: 432,973

[22] Filed: May 1, 1995

[30] Foreign Application Priority Data

Apr. 29, 1994 [DE] Germany ..... 44 15 112.8
May 20, 1994 [DE] Germany ..... 44 17 782.8

[51] Int. Cl.[6] ..... F41A 9/80

[52] U.S. Cl. ..... 89/35.01

[58] Field of Search ..... 89/35.01, 35.02; 221/76; 224/223

[56] References Cited

U.S. PATENT DOCUMENTS

| | | | |
|---|---|---|---|
| 1,150,435 | 8/1915 | Laird et al. | 89/35.01 |
| 3,182,556 | 5/1965 | Rocha | 89/35.01 |
| 3,254,565 | 6/1966 | Fever et al. | 89/35.01 |
| 4,011,788 | 3/1977 | Reed | 89/35.02 |

FOREIGN PATENT DOCUMENTS

| | | | |
|---|---|---|---|
| 495236 | 11/1938 | United Kingdom | 89/35.01 |

*Primary Examiner*—Stephen M. Johnson
*Attorney, Agent, or Firm*—R. Lewis Gable

[57] ABSTRACT

In a self-loading grenade thrower, the components or cartridges (1, 1') of which are enclosed in each instance by an annular belt member (7), each belt member (7) is provided with bulges (15, 17) lying opposite one another, which are traversed in each case by an opening (11, 11'). The adjacent openings (11, 11') of the two belt members (7) are joined articulately with one another by a connecting member (9) which traverses these openings and has on both ends an enlarged or thickened portion (23, 25) which retains its belt member. To the openings (11, 11') of the two bulges (15, 17) there are assigned two rest paths (13, 13') which are open toward an edge of the belt member (7) and the width of which is such that the connecting member (9) can be released from the opening (11) under gentle bending open or flexing of the corresponding rest path (13) by the axial, mutual shifting of two adjacent cartridges (11, 11"11'"), regardless of the direction. Preferably the enlarged portions are received untwistably in the bulges and joined with one another by a joint shaft which is articulately bendable about an axis parallel to the cartridges.

14 Claims, 4 Drawing Sheets

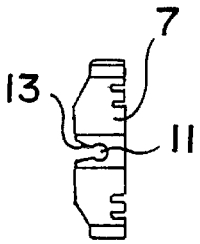
FIG. 3
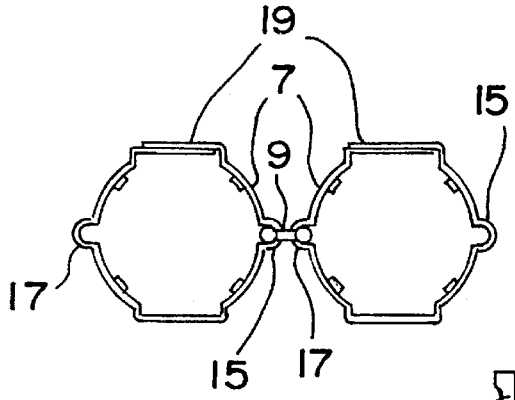
FIG. 2
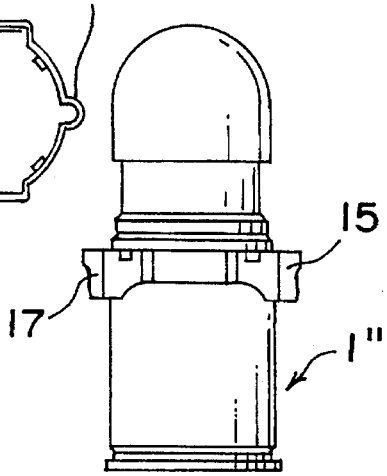
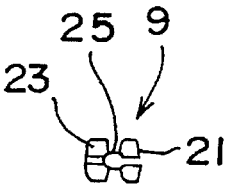
FIG. 4
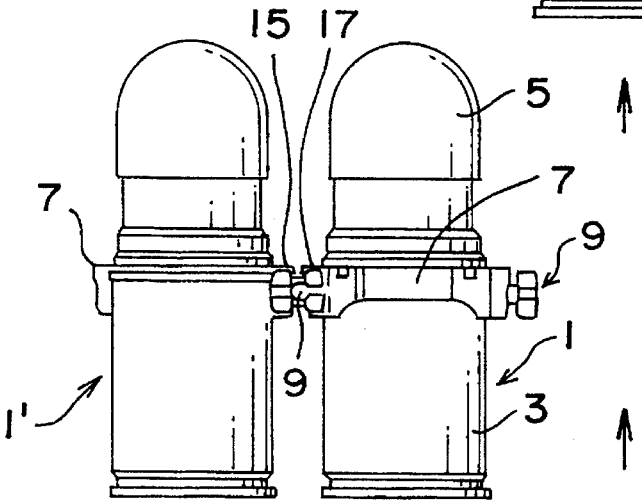
FIG. 1
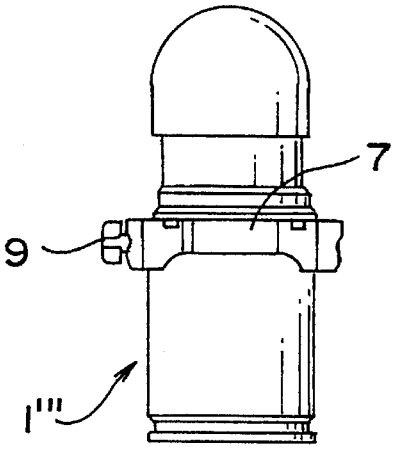

FIG. 8
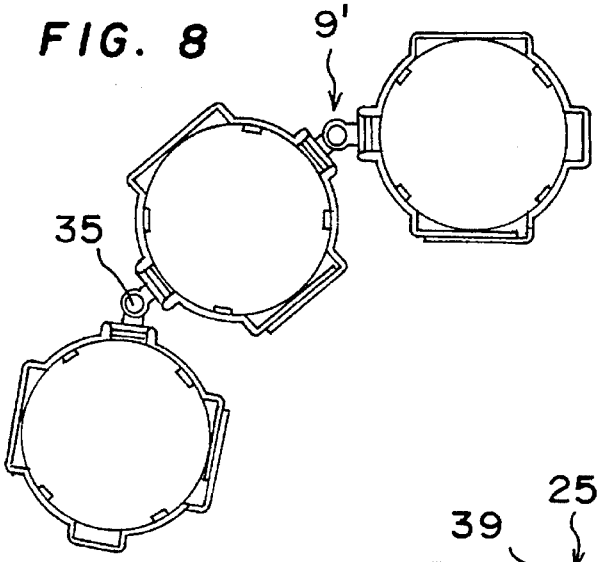
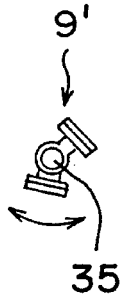
FIG. 9
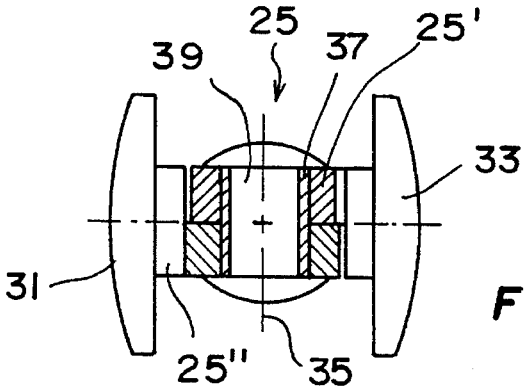
FIG. 10(b)
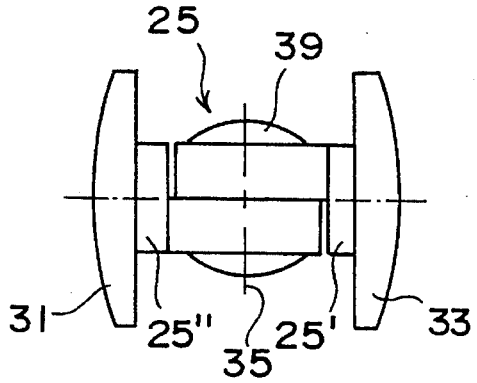
FIG. 10(c)
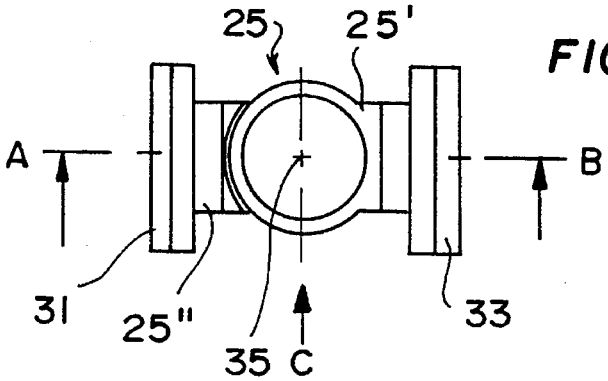
FIG. 10(a)

CARTRIDGE BELT

FIELD OF THE INVENTION

The invention relates to a cartridge belt according to the generic term of claim 1. Such a cartridge belt is used in the applicant's self-loading grenade thrower HK AGL 40 mm to feed successively the cartridges contained in the cartridge belt (cf. German patent application P 43 34 412.7–15, which corresponds to PCT/EP94/03307 of HECKLER & KOCH).

BACKGROUND OF THE INVENTION

A cartridge belt of like construction could theoretically be used, however, also for other self-loading weapons or cartridges. Finally, the term "cartridge" is used here in the broadest sense, i.e., "cartridge" is understood to mean components, e.g., bolts or nails, which are fed successively to a bolt-shooting apparatus or to another arrangement for using such components.

Further, relative position designations are used without more detailed reference in the following description; such as "in front", "radially" or the like, relate to the described belted cartridges or their longitudinal axes. For example, "in front" is used to give the direction in which a missile of the cartridge is aimed, there being assumed as a point of reference for the cartridge with nearly a cylindrical or bottle-shaped cartridge case.

The cartridge belt mentioned at the outset has, like many known cartridge belts, a number of belt members, each of which is adapted to receive a cartridge and to be jointedly connected with one another.

The belt member encloses the cartridge case near its missile-side edge like a cuff and is seated so rigidly on the cartridge case that it can be shifted along it only by force. Each belt member has a bulge lying diametrically opposite one another, and the adjacently lying bulges of adjacent cartridges are joined by a connecting member which traverses openings in the bulges with play and in each case has on an end side, between a bulge and a respective cartridge, a thickened portion which grips behind the opening in the bulge. Adjacently lying belt members, therefore, cannot be pulled apart in a radial direction. Furthermore, the thickened portion is constructed in accordance with the contour of the bulge such that the cartridge belt can be deflected not only in a radial plane of the cartridges lying parallel next to one another, but can also be twisted to a limited degree and bent in an axial plane. Such twisting and bending facilitates the feed to the weapon, but does not hamper its functioning, since in the cartridge entry to the weapon the cartridges are again aligned exactly parallel to one another.

While in a conventional cartridge belt, the cartridges in the debelting of the weapon are drawn or thrust out of the belt members, whereby the belt members are singly or connectedly ejected separately from the cases of fired cartridges. In the category-forming and inventive cartridge case, the belt member remains on the cartridge case, and in the sliding of the cartridge into the cartridge belt, it is thrust merely to the bottom of the case. The adjacently lying belt members of the debelting are exclusively separated from one another.

This separation is made possible by the fact that the opening in one of the bulges of each belt member toward the front or mostly rear edge of the belt member is open, under formation of a rest path, with a narrow passage that is less than the thickness of the connecting member, so that this member can be moved out of the corresponding opening only if it is pressed with such great force against its end that it can press this passage apart. This pressing-apart occurs as a rule resiliently, so that the narrow passage essentially returns to its initial dimensions after the debelting. However, it can also take place with deformation. Finally, it is also possible to provide, instead of the narrow passage, a desired-breaking passage. In the construction of the narrow passage, the belt member consists normally of sheet steel, but can also consist of a ductile metal or of a synthetic material. In the case of an elastic synthetic material, the belt member can also be axially compressed when the cartridge bearing is introduced.

For the debelting of applicant's known grenade thrower mentioned at the outset, the first cartridge of the cartridge belt is thrust forward with its belt member with respect to the following cartridge and, while continuing to be moved rectilinearly, the first cartridge is introduced into the cartridge bearing. In another self-loading grenade thrower already in military use, the same cartridge, even though it uses a cartridge belt that is of the same construction as the category-forming belt, operates differently. Specifically, the first cartridge is drawn to the rear with respect to the following cartridge belt, lowered into the plane of the cartridge bearing and only then, introduced forward into the cartridge bearing. Because of the different ways these two weapons operate, even when the same cartridge belt is used, the cartridge belt is introduced in the one weapon on its beginning side, while in the other weapon, in order to be functional, the cartridge belt is introduced on an end side.

In order to use those cartridge belts which are normally stowed in zig-zag layers in ammunition boxes for both types of grenade throwers, the cartridge belt must be taken out of the ammunition box, turned over and again laid in the ammunition box to permit the belt to be used with the second type of grenade thrower. This, however, is not only complicated, but the position of the cartridge belt now no longer agrees with the inscription or type indication on the ammunition box. If this box is used now, out of ignorance, for the reloading of the grenade thrower type matching to the inscription, then the cartridge belt can, to be sure, be directly loaded in the weapon; however, if attempts to shoot the thrower, possibly in a situation of great danger, the thrower will jam making it clear to the gunner that the alignment or orientation of the cartridge belt was wrong. Now it is essential to detect the cause of the jamming, to empty the ammunition box, to turn over the cartridge belt, and all this as rapidly as possible, while in contact with the enemy.

The peacetime outfitting of a military unit, to be sure, will presumably provide only one type of these grenade throwers, so that the difficulties described will not occur as long as the ammunition boxes are not repacked. Since during peacetime such equipment is typically kept as scanty as possible, it is necessary after the outbreak of a conflict to quickly re-equip. Then, all available grenade throwers, including those of the other type, must be obtained and introduced.

It is also possible that allied troops employed in common are differently equipped from the outset. In any case, there arise not only the usual supply problems, but those related to how the grenades are used with various types of throwers. First, personnel know that various types of ammunition may be used in each type of grenade thrower. Second, each grenade thrower unit will strive to equip itself with ammunition regardless of its designation, because each cartridge belt is usable in each weapon and only possibly must be realigned or turned over to be loaded. Thus, it is necessary to train personnel to deal effectively with possible confusion. The failures resulting from these confusions are obvious and do not need to be further explained here. Furthermore the set of problems described leads to the result that armies have rejected applicant's not-yet-introduced grenade thrower, despite its technical superiority to the one already introduced, in order to avoid these problems insofar as possible.

SUMMARY OF THE INVENTION

It is an object of this invention, therefore, to obviate the set of described problems.

Thus, there is provided according to the invention a second "rest path" open to the front or rear edge of the belt member, in such a manner that the first cartridge of the cartridge belt can be thrust out or drawn out of engagement with the following belt member not only to the rear or forward but either to the rear or forward. By suitably constructing the belt member, it is basically possible to arrange the second rest path lying opposite a first rest path of the one opening and pointing in the opposite direction, so that this opening is open in both a forward and a rearward direction. The other bulge of the belt member that is being discussed just now does not need to be arranged to release the connecting member, and can, therefore, be constructed in the manner known from the cartridge belt according to its category.

According to a preferred embodiment of the invention, however, the second rest path is assigned to the bulge which in the category-forming cartridge belt is without a rest path, and extends, therefore, in the same direction as the first rest path, therefore either to the front edge or, preferably, to the rear edge of the belt member. A belt member is created, accordingly which is substantially symmetrical to a middle plane which receives the longitudinal axis of the cartridge. The special advantage of this construction lies in that the belt member according to the invention, like the category-forming belt member, can be produced from a continuous ring band, the ends of which overlap and are riveted, welded or spot-welded together.

According to a further preferred embodiment of the invention the connecting member is also constructed essentially symmetrical, as a cross-toggle and is arranged not only on its one end as is the case with the category-forming cartridge belt, but also on its opposite end. In plan view, therefore, the connecting member corresponds to the cross section of a double-T girder. Each of the two cross-toggles prevents an excessively severe twisting of the cartridge belt because, after a slight turning about the longitudinal axis of the connecting member, it strikes against the inner walls of the respective bulge. The selecting of suitable dimensions and tolerances sets the permissible and also expedient twisting in simple and dependable fashion. The symmetrical connecting member is preferably connected precisely together with the symmetrical belt member, since this facilitates the assembly of the cartridge belt of the invention (the belt member and connecting member can be installed regardless of the orientation). There is also prevented the possibility that in the debelting, different loads will appear on the two ends of the connecting member. In some applications, it has proved expedient to avoid insofar as possible even a slight twisting of the cartridge belt, such as the above-described construction of the invention makes possible.

According to an alternative, likewise advantageous embodiment of the invention, it is proposed, therefore, to construct both thickened portions as rectangular plates, the contour of which is dimensioned so that it corresponds to the inner cross section of the bulges. The engagement of the longer side edges of the plates with the inner surface of the belt member within the respective bulge, adjacently lying cartridges are aligned substantially parallel. A correspondingly dimensioned play between the composite parts can provide for the requisite flexibility of the cartridge belt. Such a cartridge belt cannot hook either with a narrow, cartridge entrance of a weapon surrounded by sharp edges, since the cartridge following in each case is disposed substantially parallel to the cartridge already received in the entrance. Furthermore, the plate determines that the shaft which connects the two plates of the connecting member always lies directly in front of the rest path, so that no disturbances can arise in the debelting. Advantageously, the two outside surfaces of the plates facing away from one another are curved (in a domed fashion) in such a way that the outer front and rear edges of the two plate are spaced closed from one another than the apices of the outer surfaces of the plates. Besides a certain movability that this formation provides, the special advantage of it lies in that in the belting of the cartridges, when these are thrust into the belt members, they cannot run onto overhanging edges of the plate. The machine belting, therefore, can take place for the most part without interference.

According to a further preferred embodiment of the invention, the opening on both sides of the entry to the rest path is widened along the circumferential direction of the belt member. If during the handling of the cartridge belt according to the invention, two adjacent belt members each containing a cartridge are rotated toward one another, the connecting member coupling these with its thickened portions slips to the ends lying nearest one another of these elongated openings and thus no longer lies opposite to the rest path. A longitudinal force applied to the adjacent cartridges which could debelt or remove these cartridges is thus absorbed by the edge of the openings, so that a debelting in this rotated position of the adjacent belt members, as might occur with a bent-off cartridge belt, is prevented. Only if the two belt members lie next to one another so that the entire cartridge belt extends rectilinearly in their position, and the two belt members are drawn apart slightly in the longitudinal direction of the cartridge belt (as is the case during the ammunition feeding of a weapon) does the connecting member move directly in front of the respective rest path and the debelting is possible without excessive expenditure of force.

According to a further embodiment of the invention, the entry of the rest path into the respective opening is widened, so that in the debelting the connecting member moves more easily into the rest path. As already remarked above, the connecting member with thickened portions constructed as rectangular or square plates hinders the often-undesired twisting of successively following cartridges and their belt members and improves the easy debelting through the feature that the shaft connecting the two plates of the connecting member always remains aligned to the respective rest path.

In order to improve the movability of the belt in a direction transverse to the cartridges but also to improve the connection rigidity of the cartridge and the dependable debelting, a further embodiment of the invention proposes to provide the shaft connecting the two plates with a joint, so that it is bendable about an axis and, as a result, the two adjacent cartridges are rotatable about this axis which runs parallel to the longitudinal axes of these two cartridges. Such a joint connection neither must be a hinge with a fixed axis, nor is required that its shaft be absolutely constructed in two parts. Instead of the shaft, there can be provided, rather, a flexible spring plate strip or a bolt- or roll-chain.

According to a preferred embodiment, however, the shaft is formed from two separate shaft sections, at least one of which has a bearing bore traversed by a pivot pin, by means of which the respective shaft section is rotatably mounted. The pivot pin can be molded or fastened to the other shaft section. According to a preferred embodiment of the invention, however, it is constructed as a separate part, and each end of the two shaft sections are provided with a bearing bore and are either reduced to half their thickness or cropped. In any case, the two shaft sections are of like construction and are installed facing one another and turned with respect to one another. The two cropped ends, for example, lie one over the other, so that their bearing bores are aligned with one another to receive a pivot pin.

The parts production and the assembling of the cartridge belt according to the invention are, therefore, simplified. The pivot pin may comprise a solid bearing metal, e.g., bearing bronze. In order to reduce production costs, the bearing pin may be constructed as a hollow pin. This could overhang both ends of the passage bore formed by the shaft sections lying one over the other and be deformed outward like a hollow rivet to thereby hold the two shaft sections together. The hollow pin, therefore, may have an especially thin wall thickness, since it serves only the purpose of offering a bearing with low friction. The forces that act on the joint connection, however, are absorbed by the pin which extends through the hollow pin. Insofar as this pin is constructed as a rivet, this can project over the hollow pin and be riveted radially to the outside, so that this rivet also holds the joint together.

DESCRIPTION OF THE DRAWINGS

Two preferred examples of execution of the cartridge belt according to the invention are explained by way of example, with the aid of the attached drawings, in which:

FIG. 1 shows the weapon-side end of the cartridge belt of the invention according to a first embodiment, with a cartridge debelted forward and a cartridge debelted to the rear, in reduced representation, FIG. 2 is a plan view of two belt members of the cartridge belt, joined with one another on the same scale as that of FIG. 1, FIG. 3 is a side view of a belt member, on the same scale as that of FIG. 1, FIG. 4 is an elevation view of a connecting member of the cartridge belt, on the same scale as that of FIG. 1, FIG. 5(*a*) is a side view, 5(*b*) a plan view, 5(*c*) an opposite side view and 5(*d*) an underview of a belt member, about in original size, FIG. 8 is a plan view of three belt members joined with one another for a second embodiment of the cartridge belt according to the invention, FIG. 9 is a plan view of a connecting member of the cartridge belt of FIG. 8, FIGS. 10(*a*) to (*c*) show respectively a plan view, a partial elevation and elevation of the connecting member of FIG. 9, in an enlarged representation.

Like reference numbers signify in all figures like elements or components; the description made in the explanation of a figure holds for all figures. The terms used in the description of the figures, such as "above", "below" etc. relate to the representation in FIGS. 1 and 7, where "above" means "on missile side" and "below" signifies on cartridge bottom side".

DETAILED DESCRIPTION OF THE PREFERRED EMBODIMENTS

Figure 5D:
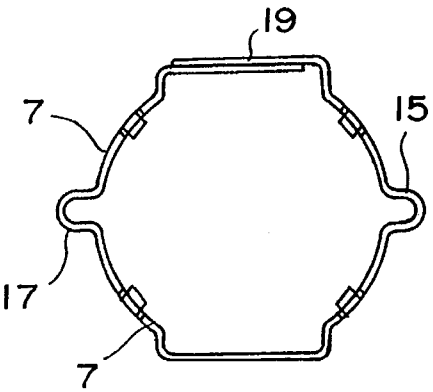
Figure 5C:
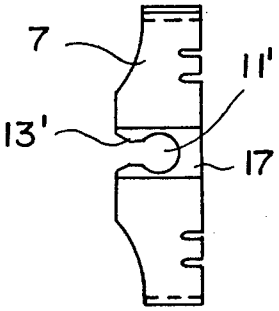
Figure 5B:
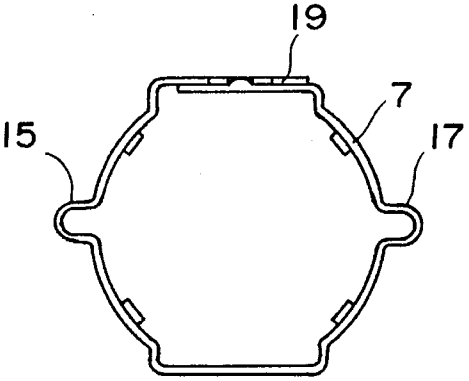
Figure 5A:
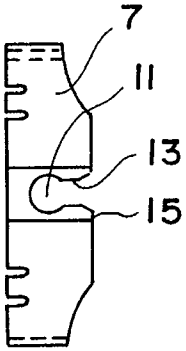
Figure 6:
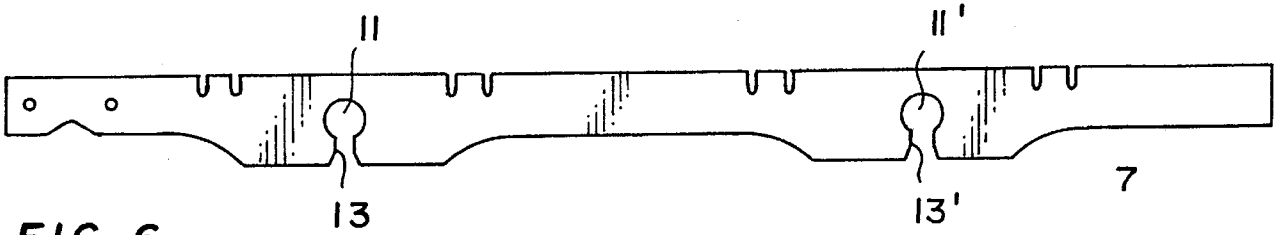
FIG. 6 shows the belt member in development, or the stamped-out steel plate strip for the production of the belt member, about in original size.

Reference is made first to FIGS. 5 and 6. FIG. 6 shows a stamped-out, elongated sheet steel strip, the rolling direction of which runs in its longitudinal direction. From the edge lying above in the drawing, running essentially rectilineally, there extend downward four pairs of adjacent short incisions; these bound, pairwise in each case, a spring tongue, all of which, in an annular belt member 7 shown in FIG. 5, are bent inward, and ensure that the belt member 7 has a rigid seating on a cartridge case 3 (FIG. 1). Furthermore, the orientation of the spring tongues does, to be sure, permit the shifting of the belt member 7 in the direction of the bottom of the cartridge case 3, but blocks the belt member 7 against a displacement which tends to shift the belt member 7 downward beyond the upper edge of the cartridge case.

Between two pairs of incisions in each case, the metal strip is widened; in the middle of each widening there is located one of a pair of round stamping-outs or openings 11 and 11', each of which is open downward through each of a pair of a rest paths 13 and 13' to the lower edge of the widening. Each of the rest paths 13 and 13' has in the section bordering on one of the respective openings 11 and 11' a section with parallel, downward-running walls, the reciprocal spacing of which is clearly less than the diameter of the openings 11 and 11' and a little less than the diameter of a shaft 25 of the connecting member 9 (FIG. 4). The lower run-out of the rest paths 13 and 13' is conically enlarged in order to facilitate the assembling of the cartridge belt. The dimensions of the two openings 11 and 11' and of the two rest paths 13 and 13' as well as of the two widenings are in each case corresponding.

The stamped-out steel strip shown in FIG. 6 is bent into a ring band. As is best shown in FIGS. 5*b* and 5*d*, the two widenings form a first bulge 15 and a second bulge 17, which lie diametrically opposite each other and have a U-shaped cross section. The inner spacing between the two shanks of this U cross section is only slightly greater than the thickness of the cross toggles 21 and 23 (FIG. 4). The radial length of the U-shaped cross section is a little greater than its shank spacing.

Upon each of the bulges 15 and 17, there follows a circular arcuate section, the inside diameter of which corresponds to the outside diameter of the cartridge case 3 (FIG. 1) and on which the above-mentioned spring tongues are formed. Offset by 90° to the bulges 15 and 17, and lying opposite one another, there are formed two flattened projections, the flattened section of which extends in each case parallel to the connecting line between the middles of the two bulges 15 and 17, lies with its inner side tangentially on the cartridge case 3 and serves for the guidance of the cartridge belt. In the zone of one of the flattenings, the ends of the sheet steel strip shown in FIG. 6 overlap at position 19 and are spot-welded with one another.

In FIG. 1, on a reduced scale, there are shown 40 mm grenade thrower cartridges 1, with the cartridge case 3 and a missile 5. Over this the described belt member 7 is brushed and thrust onto the upper, edge-near section of the cartridge case 3, where the belt member 7 is in rigid clamp-seating, due to the above-described spring tongues.

In each case, one of the bulges 15 and 17 of two adjacently lying belt members 7 is arranged beside the other in such a way that the openings 11 and 11' are aligned upon one another. The connecting member 9 (see especially FIG. 4) with the slender cylindrical shaft 25, on the end of which in each case there is formed the cross-toggles 21 and 23, traverses these two openings 11 and 11' with its shaft 25 and grips each of the cross-toggles 21 and 23. The two cross-toggles 21 and 23 have the same dimensions, so that the connecting member 9 as a whole is symmetrical. Furthermore, each of the cross-toggles 21 and 23 is formed slightly rounded or barrel-shaped, with a least diameter which is greater than the diameter of the shaft 25.

The attachment of the connecting member 9 is seen in FIGS. 1 and 2. As is recognizable, the rounded form of the cross-toggles 21 and 23 provides that adjacent cartridges 1 to a certain limited degree to be sure, can be rotated and twisted freely with respect to one another. The rotation in a radial plane of the cartridges 1 is possible only so far up that the adjacent belt members 7 collide with the edges of their flattened projections.

In the assembly of a cartridge belt, the connecting members 9 are pressed from underneath into the widened entrance of the rest paths 13 and 13' of their respective openings 11 and 11' lying adjacent to one another of the two belt members 7. The shaft 25 then presses the side walls of the rest paths 13 and 13' slightly apart, until the connecting member 9 with its shaft 25 is disposed within the openings 11 and 11' and, due to the resilience of the side walls, remains held therein.

In the shooting, the first cartridge 1 of the cartridge belt 7 loaded in the weapon, depending on the weapon type, is either thrust forward (cartridge 1 in FIG. 1) or drawn to the rear (cartridge 1' in FIG. 1). In the first case, the connecting member 9 remains attached to the second cartridge 1, as shown in FIG. 1, and in the second case, it remains attached to the cartridge 1' which is drawn to the rear. In any case, the shaft 25 of the connecting member 9 is moved relatively to its rest path 13 or 13' and in the process, presses the flexible walls of the path apart.

As is evident, the cartridge belt 7 can be used in every type of weapon without being especially equipped therefore. It is now no longer necessary to prepare loose cartridge belts 7 for use at the firing position, since it is now no longer a critical matter which end of the cartridge belt 7 is put into the weapon. It is possible, to be sure, to debelt adjacent cartridges in any mutual relative position. Thus, it is possible, for example, that a cartridge belt 7 that is rolled up or laid in zig-zag layers—which accidently falls from a considerable height, say from a truck, onto hard ground—will be "debelted" by this impact, and as a result can be undesirably disconnected from two cartridges.

Figure 7:
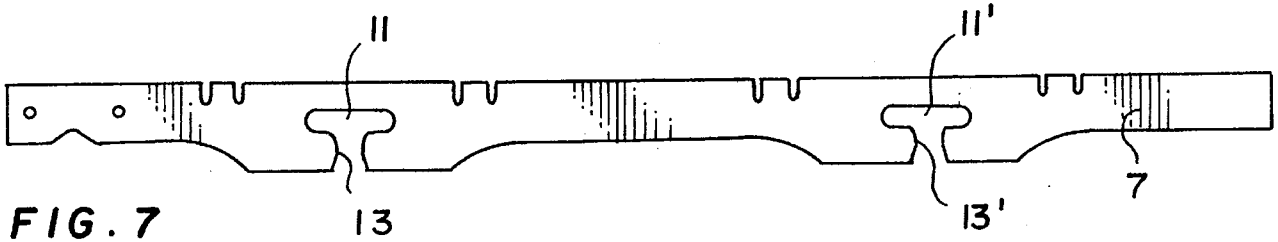
FIG. 7 is a representation of a developed belt member as shown in FIG. 6, but with modified openings.

This danger is largely obviated by the use of the belt members 7, such as the one shown in the rolled-up representation in FIG. 7. In this modified belt member 7, each of the openings 11 and 11' is constructed as an oblong hole, which extends in the circumferential direction of the belt member 7, therefore in its lengthwise direction in the unwound representation as shown in FIG. 7. The rest paths 13 and 13' widen from its narrowest place toward the oblong holes 11 and 11', and opens into the middle portions of the respective holes 11 and 11'. It is also possible for the oblong holes 11 and 11' to be widened toward the entrance of the respective rest paths 13 and 13'.

When the cartridge belt 7 is loaded into a weapon, at least the first two belt members 7 lie in contact with the respective cartridges 1 and 1' on a flat guide, in which a pair of flat portions 19 lying on this guide of the first two belt members 7 align therewith in such manner that the cartridge belt section formed by them extends in a straight line. In this embodiment, the connecting member 9 is located with its shaft 25 directly in front of the entrance of the respective rest paths 13 and 13' because the two cartridges 1 and 1' or belt members 7 are drawn apart shortly before the debelting. The debelting is now possible in the manner in which it is described above in connection with the original execution of the openings 11 and 11'.

In the case of cartridges 1 and 1' and belt members 7 angled-off to one another, the connecting member 7 slips into the ends facing one another of the oblong-hole openings 11 and 11' of the two adjacently lying belt members 7 and in this position, cannot be thrust into the rest paths 13 and 13'. In this position, therefore, a separating of the belt members 7 from one another is not possible.

In FIGS. 8, 9 and 10, there is shown a second embodiment of the cartridge belt 7 according to the invention. This embodiment is similar to all of the features of the first embodiment shown in FIGS. 1 to 7, except for a connecting member 9', in which the belt member 7 can have both the construction shown in FIG. 7 and also that of FIG. 6, which is preferred. These similar features are not described again; a description of these features is made above with respect to FIGS. 1 to 7.

A pair of thickened portions 31 and 33 of the connecting member 9' is constructed in each case as square, or preferred, rectangular plates, the cross section of which in each case lies in a plane oriented precisely perpendicular to the length dimension of the connecting member 9', which in turn lies parallel to a plane that lies tangentially to the cylindrical case of the adjacent cartridges 1 and 1'. The longer sides of the rectangle extend parallel to the lengthwise axis of the cartridges 1 and 1'. The outer surfaces facing the cartridges 1 and 1' are constructed of a domed or spherical configuration in such a manner that the domed surface disposed between the upper and lower shorter sides of the rectangle form an outward projecting apex, which is parallel to these shorter sides. In turn, these short sides represent a tangent to the circular cross section of the cartridge case. The middle portions of these apices are joined by a longitudinal axis which cylindrically forms at its ends the longitudinal axis of the shaft 25.

While the first embodiment of this shaft 25 is constructed as a single, rigid component, the second embodiment is composed of two shaft sections 25' and 25", each of which is formed as one piece with the respective thickened portions 31 or 33. The component formed by the thickened portion 31 and the shaft section 25" is of like construction with that of the other thickened portion 33 and the shaft section 25'. Each of the shaft sections 25' and 25" has, bounding on the corresponding thickened portions 33 and 31, a short cylindrical connecting piece, upon which then an eye-type thickening follows, with a continuous bearing bore perpendicular to the longitudinal axis, parallel to the long sides of the rectangular cross section of the thickened portions 31 and 33. The axis of this bore forms a pivot axis 35. This eye-type thickened portion extends, as seen radially to the cylindrical connecting piece, only to the longitudinal axis of the shaft 25 and ends in a slide surface which is oriented perpendicularly to the pivot axis.

In the installation, the two components just mentioned with the shaft sections 25' and 25" are turned toward one another and thus turned through 180° with respect to one another, so that the two slide surfaces lie one upon another and the two bearing bores form a continuous receiving bore, into which there is placed a hollow pin or sleeve 37. The sleeve 37 is preferably made of a material having a low coefficient of friction with respect to the two components 31 and 25", and 33 and 25' (bearing metal, synthetic material such as PTFE) with low play, so that these two components can be easily rotated with respect to the hollow pin 37. The hollow pin 37 closes off snugly the end of the respective bearing bore away from the slide surface or preferably projects a little from each bearing bore.

The inner bore of the hollow pin 37 is traversed by a rivet 39, which projects beyond both ends of the hollow pin 37 to provide exposed portions, which are each machined to form a rivet head (see FIGS. 10*b* and *c*). These rivet heads in turn grip radially over the edge of the respective bearing bore and thus prevent the two components 31 and 25", and 33 and 25' from being released from one another.

The exact construction of the connecting member 9' is shown in the plan view (in the direction of the pivot axis 35) of FIG. 10(*a*), from the section A–B through this plan view, presented in FIG. 10(*b*) and from the side view from direction C in its plan view of FIG. 10(*c*). The dimensional relationships shown in these figures are preferred. In particular, it is seen that the bearing bore has a considerable length, which provides for an articulate, but completely twist-rigid connection of the two shaft sections 25' and 25".

The length of the shorter sides of the rectangle that forms the cross section of the thickened portions 31 and 33, is aligned with the inner width of the bulges 15 and 17 (see FIG. 5) of the belt member 7, so that the longer side flanks of the thickened portions 31 and 33 lie flush against the inner surfaces of the bulges 15 and 17 and thus ensure that the respective shaft section 25 and 25" cannot be rotated in a circumferential direction of the adjacent cartridges, 1 and 1'. Simultaneously the cartridges 1 and 1' press against the apex of the corresponding thickened portions 31 and 33, and in turn force the apex against the inner surface of the bulges 15 and 17, so that the respective shaft sections 25" and 25' cannot rotate either in a longitudinal direction of the cartridge 1, 1', but remain always radially fixed with respect to the cross section of the case. The domed construction of the outer surfaces of the thickened portions 31 and 33 ensures that as the cartridges 1 and 1' are being slid into the belt members 7, the case edge does not run onto an edge of the thickened portions 31 and 33.

As shown in FIGS. 8 and 9, adjacent belt members 7 and thus the cartridges 1 and 1' can be rotated with respect to one another directly about the pivot axis 35, but are otherwise joined substantially twist-rigidly with one another. The cartridge belt, therefore, can directly enter an input opening of a weapon, it can directly follow all direction changes in a plane which stands perpendicular to the longitudinal axes of the cartridges, but is at least twist-rigid to the extent that it is not possible, for example, for a cartridge to be caught on the input opening.

A very special advantage of the second embodiment of this invention permits a dependable debelting even when the cartridge belt is bent off at an angle. Since there is a joint connection between the two shaft sections 25' and 25", these sections are not aligned with one another, but nevertheless lie opposite their respective rest paths 13. This relationship is clearly shown in FIG. 8, where it is appreciated that, regardless of the bending of the joint, the shaft sections 25' and 25" remain in the same position that they would occupy if the two shaft sections 25' 25" were in alignment with one another.

Figure 11:
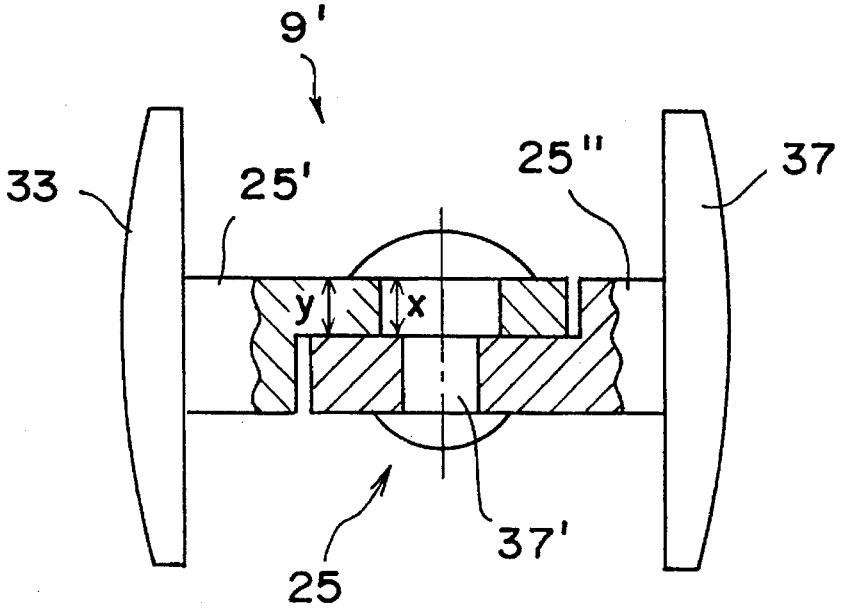
FIG. 11 is a partial elevation section through a further example of execution, similar to the representation in FIG. 10(*b*)

In FIG. 11, there is shown a further embodiment of the connecting member, which is likewise constructed with two separate shaft sections 25' and 25". These two shaft sections 25' and 25" are not, to be sure, similar to those of the preceding embodiments, but rather each includes an equal bearing bore, but with a larger and a smaller bore which, lying one over another, form an offset bearing bore. The offset bearing bore is traversed by a bearing pin 37', which is constructed complementarily to the bearing bore with two offset sections. The bearing pin 37' consists of a metal, preferably a bearing metal, which forms a low coefficient of friction with the two shaft sections 25' and 25". Like the rivet 39 of the preceding embodiment, the bearing pin 37' has on both ends a head the diameter of which is greater than the inside diameter of each adjoining bore.

To permit an unrestricted movement between the two shaft sections 25' and 25" (besides the easy-motion fitting of the bearing bore and the bearing pin 37'), the length of the sections, as measured between its two heads, is made slightly greater than the height of the bearing bore traversing the two shaft sections 25' and 25". The sections 25' and 25" act like a hinge, and the aforementioned dimensioning introduces a certain amount of axial play so that the sections do not jam; this play, directly settable by the specialist, is here designated as "hinge play." Preferably the axial length x of the section of the bearing pin 37' with the greater diameter, is set greater by the hinge play than the axial length y of the bore in the corresponding shaft section 25'.

Figure 12:
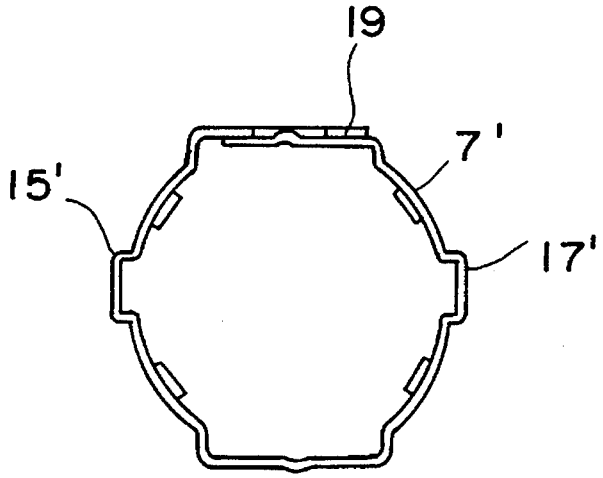
FIG. 12 is a plan view of another example of execution of the belt member, similar to the representation in FIG. 5(*b*).

In FIG. 12, there is shown in plan view of a further embodiment of the belt member 7 shown in FIG. 5(*b*). To this belt member 7' of FIG. 12, there is incorporated the construction of FIG. 6. As shown in FIG. 12, the bulges 15' and 17' are not constructed like the bulges 15 and 17 of the embodiment of FIG. 5, but rather of a shorter length as seen in the circumferential direction of the cartridge cross section, a greater height as seen in the radial direction of the cartridge cross section, and with a greater length and a shorter height, so that the cross section of each of the bulges 15' and 17' (as shown in plan view of FIG. 12) forms a narrow rectangle extending tangentially to the circumferential direction of the cartridge cross section. The end rounding of the embodiment shown in FIG. 5 is altogether absent.

The thickened portions 31 and 33 of the corresponding connecting member 9', as shown in from FIG. 11, are constructed in a complementary fashion to the bulges 15' and 17'. Here the connecting member 9' is supported primarily by the inner surfaces of the two thickened portions 31 and 33 which face one another on the respective inner surface of the outer wall of the respective bulges 15' and 17'. The thickness of the thickened portions, as seen in the axial direction of the shaft 25, can thus be reduced and, as a result, the joint of the shaft 25 can be made larger and thus more stable and with greater permissible tolerances, without it being necessary to change the spacing between the adjacent cartridges 1 and 1'.

We claim:

1. A component belt for mounting thereon a plurality of components, each of the plurality of components having an axis and a circumferential cross-section, said component belt mounting said plurality of components to lie adjacent to one another with the axes of the components oriented parallel to each other for feeding one component at a time to a component using apparatus, said component belt comprising:

a) at least first and second belt members, each of said first and second belt members for mounting a corresponding one of the plurality of components and being of an annular configuration in accordance with the circumferential cross-section of its mounted component, each of said first and second belt members including first and second bulges disposed opposite each other about said annular configuration and further including a first edge and a second, opposing edge, said first and second bulges having therethrough first and second openings respectively, each of said first and second openings having a first dimension; and b) a connecting member for insertion through said first opening of said first belt member and said second opening of said second belt member to articulately and releasably join said first and second belt members together, said connecting member comprising a joining portion having a second dimension and opposing ends, and enlarged portions affixed respectively to said opposing ends of said joining portion and having a common, third dimension greater than said second dimension;

c) said first opening of said first belt member communicating with one of its first and second edges by a first path within said first belt member, said second opening of said second belt member communicating with its same one edge by a second path within said second belt member, each of said first and second paths having a narrowed portion of a fourth dimension of a minimum extent along said circumferential cross-section of the component mounted within its belt member, said forth dimension being less than both of said first dimension and said third dimension, said first and second belt members being made of a flexible material to permit said connecting member to widen and thereby be withdrawn through each of said first and second paths, said connecting member being withdrawn in a first direction through said first path within said first belt member and in a second direction opposite to said first direction through said second path of said second belt member.

2. A component belt according to claim 1, wherein said first and second paths of each of said first and second belt members connect respectively its first and second openings with said same one edge thereof.

3. A component belt according to claim 1, in which said enlarged portions of said connecting member are constructed as cross-toggles symmetrical with each other.

4. A component belt according to claim 1, in which said enlarged portions at both ends of said connecting member are constructed as a plate of a rectangular cross section with an outside surface of domed configuration, said enlarged portions arranged for untwistable reception within said first and second bulges respectively.

5. A component belt according to claim 4, in which said enlarged portions of said connecting member are joined by a shaft, said shaft comprising two shaft sections which are articulately jointed to pivot about an axis which is oriented substantially parallel to the axes of the components mounted within said first and second belt members.

6. A component belt according to claim 5, wherein at least one of said two shaft sections includes an end facing another of said two shaft sections and a bore mounted on said end and constructed as a bearing bore, said bearing bore having ends and there is further included a pivot pin mounted traversly within said bearing bore.

7. A component belt according to claim 5, wherein said two shaft sections are constructed alike, each of said shaft sections including one end facing another of said shaft sections and a bearing bore mounted on said one end and recessed over half of a height of said bearing bore in a direction of said axis, and a separate pivot pin is disposed to traverse said bearing bores of said shaft sections.

8. A component belt according to claim 7, wherein said pivot pin is constructed as a hollow pin and includes ends from which radial projections are arranged to hold together said shaft sections.

9. A component belt according to claim 8, wherein there is included a solid rivet with a rivet head disposed on either end thereof to form said radial projection, said solid rivet being disposed traversely through said hollow pin.

10. A component belt according to claim 6, wherein said bearing bores have inside different diameters respectively, said bearing bores having respective lengths and being traversed by a bearing pin which has outside diameters complementary to said inside diameters, said bearing pin has a head disposed outside of said ends of said bearing bores, and said heads having a distance therebetween which is greater by a selected length than a total of said lengths of said bearing bores to provide a desired play between said bearing bores and said bearing pin.

11. A component belt according to claim 4, wherein each of said first and second bulges as viewed in a direction of the component axes have a narrow, rectangular cross section with a first long side open to the interior of its belt member, and a second long side, which is disposed further from its component axis than said first long side and extends transversely to a radius of the cross-section through its component that intersects centrally said second long side.

12. A component belt according to claim 1, wherein said dimensions of each of said first and second paths are widened along said circumferential cross-section on both sides of said narrowed portion of said first and second paths respectively.

13. A component belt according to claim 12, wherein said first and second rest paths diverge at their entry into said first and second openings respectively.

14. A component belt according to claim 1, wherein said second opening of said first belt member is connected by a second path to another of said first and second edges, and said first opening of said second belt member is connected by a first path to said same other edge thereof.

* * * * *